United States Patent [19]

McGonigal

[11] 4,259,653

[45] Mar. 31, 1981

[54] ELECTROMAGNETIC RECIPROCATING LINEAR ACTUATOR WITH PERMANENT MAGNET ARMATURE

[75] Inventor: James J. McGonigal, Binghamton, N.Y.

[73] Assignee: Magnetic Laboratories, Inc., Hallstead, Pa.

[21] Appl. No.: 853,958

[22] Filed: Nov. 22, 1977

[51] Int. Cl.[3] ..... H01F 7/08

[52] U.S. Cl. ..... 335/230; 310/15; 310/30; 400/124; 318/120

[58] Field of Search ..... 310/15, 30; 335/229, 335/230, 234, 235, 274; 400/124; 318/120

[56] References Cited

U.S. PATENT DOCUMENTS

| | | | |
|---|---|---|---|
| 3,218,523 | 11/1965 | Benson | 335/234 |
| 3,386,378 | 6/1968 | Bradbury et al. | 318/120 X |
| 3,454,956 | 7/1969 | Icenbice, Jr. et al. | 335/229 X |
| 3,543,279 | 11/1970 | Rempel et al. | 335/274 X |
| 3,745,495 | 7/1973 | Chai et al. | 335/229 |
| 3,755,766 | 8/1973 | Read, Jr. | 335/229 |
| 3,775,714 | 11/1973 | Heuer | 335/230 |
| 3,946,851 | 3/1976 | Cestrieres et al. | 335/234 |
| 4,046,244 | 9/1977 | Velazquez | 400/124 |
| 4,129,187 | 12/1978 | Wengryn et al. | 310/30 X |

OTHER PUBLICATIONS

IBM Tech. Disclosure Bulletin, "Actuator for Wire of Matrix Printer", Meier, vol. 20, #8, 1/78.

*Primary Examiner*—Donovan F. Duggan

*Attorney, Agent, or Firm*—Sughrue, Rothwell, Mion, Zinn and Macpeak

[57] ABSTRACT

A spring-less linear actuator, especially useful as a print wire drive. A permanent magnet armature is driven from a rest position on a pole piece by magnetic repulsion upon energization of a solenoid by a D.C. pulse. The armature is fixed to a print wire which rebounds from a printing medium, thereby returning the permanent magnet toward the rest position, where it is held, without bouncing, by the magnetic attraction between the armature and the pole piece of the solenoid, which is now de-energized.

4 Claims, 2 Drawing Figures

ELECTROMAGNETIC RECIPROCATING LINEAR ACTUATOR WITH PERMANENT MAGNET ARMATURE

BACKGROUND OF THE INVENTION

1. Field of the Invention

This invention relates generally to the field of electromagnetic linear actuators and, more particularly, to a reciprocating actuator employing a permanent magnet armature which is driven by magnetic repulsion, rather than magnetic attraction.

2. Description of the Prior Art

Linear motors of the positioning type and employing permanent magnet armatures are known; see U.S. Pat. No. 3,135,880. Also known are electromagnetic linear actuators for print wires, but such actuators employ ferromagnetic armatures which are driven by magnetic attraction against the force of a restoring spring which returns the armature to a rest position after a printing operation; see U.S. Pat. Nos. 3,850,278 and 3,755,700; such actuators require a relatively large electromagnetic tractive force in order to overcome the increasing resistive force of the spring as the print wire approaches the printing medium; furthermore, the armature of such actuators is subject to bouncing when it is returned to its rest position by the force of the restoring spring.

SUMMARY OF THE INVENTION

The object of this invention is to provide an improved electromagnetic actuator of the impact type which does not require a restoring spring and which is especially useful as a print wire actuator in a matrix printer.

Another object of the invention is to provide an electromagnetic linear actuator employing a permanent magnet armature which is driven by magnetic repulsion from a rest position, returned to the rest position by rebounding from a surface, and then held in the rest position by magnetic attraction.

Briefly, the above objects are accomplished by means of a structure including a permanent magnet armature moving axially within a solenoid having a fixed pole piece. In the rest position, the permanent magnet is magnetically attracted to, and held against, the pole piece. When the solenoid is momentarily energized, the armature is repelled from the pole piece with great force, is returned towards the pole piece after rebounding from a surface, and then is magnetically attracted to the pole piece in a rest position by means of the magnetic attraction between the pole piece and the permanent magnet armature.

DETAILED DESCRIPTION OF THE PREFERRED EMBODIMENT

Figure 1:
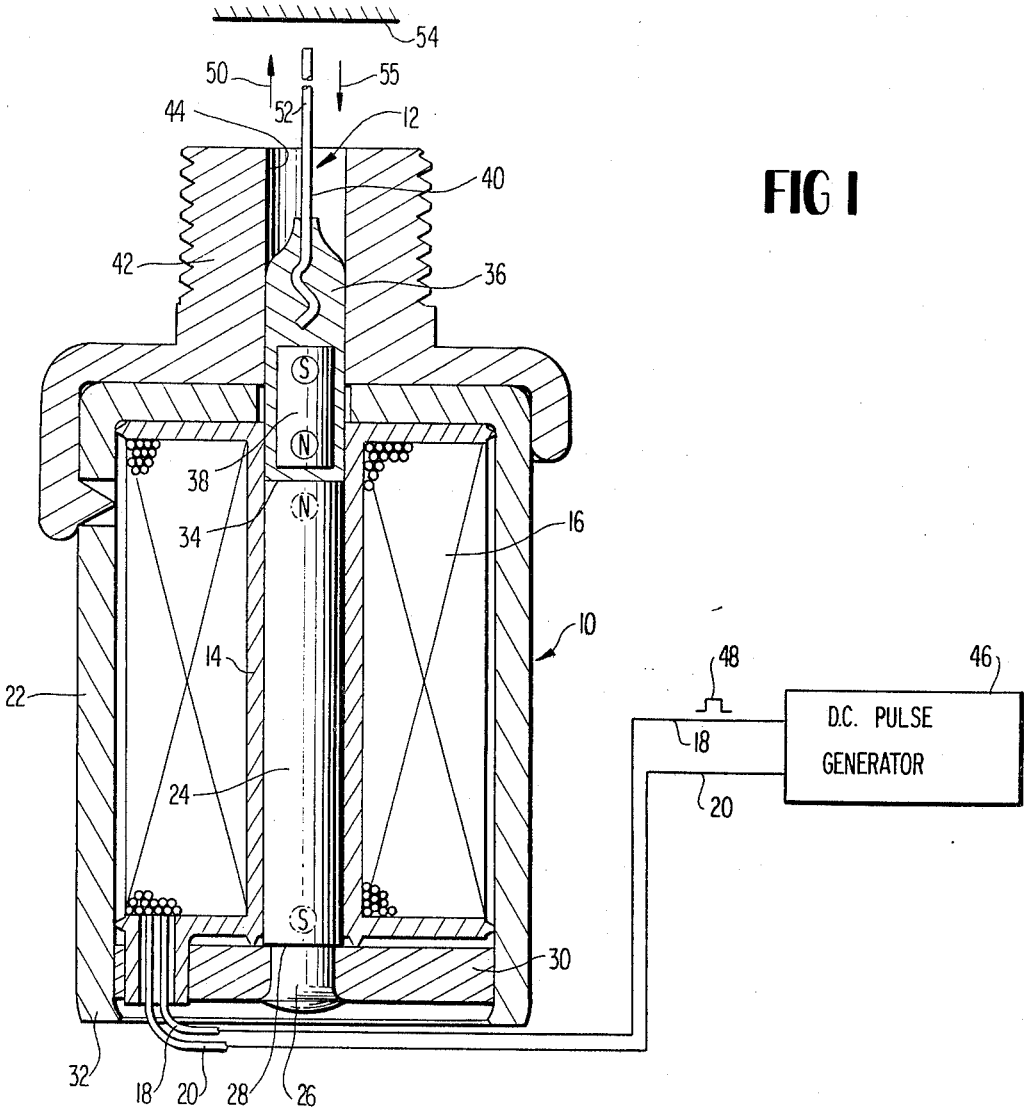
FIG. 1 is a cross-sectional view of a preferred embodiment of the invention.

FIG. 1 illustrates a preferred embodiment of the invention in the form of a print wire actuator, a plurality of which may be combined in a print head.

The two main components of the actuator are a solenoid or coil assembly 10 and a permanent magnet armature assembly 12. Coil assembly 10 consists of a bobbin

14 upon which is wound a solenoid or coil 16 having two external electrical leads 18 and 20. The bobbin is secured to a ferromagnetic cup-shaped shell or housing 22. A ferromagnetic cylindrical pole piece 24 is fitted in the central bore or passageway of the bobbin and has at the lower end thereof a portion 26 of reduced diameter which forms a shoulder 28 near the lower end of the pole piece. A ferromagnetic end cap 30 closes the bottom end of the shell 22 and contains a central bore through which the reduced portion 22 projects and then is upset to securely fix the pole piece to the end cap which in turn is securely fixed to the shell by swaging inwardly the lower end 32 thereof. The shoulder 28 of pole piece 24 abuts the upper surface of the end cap 30 and thus accurately positions the upper end 34 of the pole piece relative to the height of the bobbin bore to determine the rest position of the armature assembly 12. In this rest position, the armature assembly rests against the upper surface of the pole piece 14.

Armature assembly 12 is positioned within the upper end of the bobbin central bore or passageway and consists of an injection molded cylindrical element 36 in which are inserted a cylindrical permanent bar magnet 38 and a print wire 40. The permanent magnet 38 is a very light, high energy rare earth magnet, made of samarium cobalt, for example.

An adapter bushing 42 is fixed to the top of the shell 22 and includes a central bore or passageway 44 for guiding the vertical movement of the armature assembly 12. The bushing carries external threads for use in assembling it in a print head. The external leads 18 and 20 of the coil are connected to a conventional D.C. pulse generator 46 which is controllable to produce D.C. pulses, such as pulse 48. The leads 18 and 20 therefore act as means for applying current to the coil to energize it.

By way of example, permanent magnet 38 is shown in an orientation wherein its north pole N is at its lower end adjacent the top surface 34 of the pole piece 24, while its south pole S is at the opposite end of the permanent magnet. Because of the magnetic attraction between the permanent magnet and the pole piece 14, the armature assembly is normally held against the top of the pole piece when the armature assembly is in its rest position, i.e., when the coil 16 is not electrically energized.

The winding direction of the coil 16 and the polarity of the pulse 48 are chosen such that, when the coil is electrically energized by application of the pulse 48 thereto, the upper end of pole piece 34 assumes the same polarity as the lower end of the permanent magnet 38, i.e., due to the electromagnetic field, the upper end of pole piece 24 also becomes a north pole. Consequently, the armature assembly 12 is immediately repelled with great acceleration in the direction indicated by arrow 50. The free end 52 of the print wire 40 strikes a stationary object, such as a printing medium 54, which causes the armature assembly to rebound in the direction indicated by arrow 55 toward the top portion 34 of the pole piece 24. Since the duration of the pulse 48 is chosen to be less than the time required for a stroke of the armature assembly 12, i.e., less than the time required for the armature assembly to leave the pole piece 24 and strike the printing medium 54, the electromagnetically induced north pole in the top portion of pole piece 24 has disappeared, and the top of the pole piece is now magnetically neutral. As a result, the permanent magnet is attracted toward the pole piece. Therefore, the armature assembly is returned to its rest position by both the rebounding force and the force caused by the magnetic attraction between the permanent magnet and the pole piece. This magnetic attraction acts as a damping mechanism to minimize or eliminate any bouncing of the armature assembly against the top of the pole piece.

In a typical application, the D.C. driving pulse 48 has a duration of approximately 400 microseconds which is less than the time required for the initial stroke of the armature assembly. With a stroke of approximately .0.015 inch, the armature assembly reaches a velocity of twenty to forty inches per second with an impact force of three to five pounds.

The linear actuator, described above and illustrated in the drawing, is driven by a magnetic repulsion, and does not require the restoring spring needed in prior art tractive linear actuators. This novel linear actuator has the advantages of rapid acceleration, long stroke capability, high early force, an inherent return bias, and low manufacturing cost. Furthermore, after the initial acceleration, the armature assembly travels at a relatively constant velocity over a relatively long stroke distance. In addition, because no return spring is required, the magnetic driving force does not have to overcome the resistance of a spring as the armature assembly reaches the end of its stoke. The armature assembly is returned to its rest position by both the mechanical rebounding force and the magnetic attraction to the pole piece, which attraction also provides magnetic damping to reduce or eliminate bouncing in the return cycle. Because of the small size of this novel linear actuator, coupled with the low mass and resulting high velocity of the permanent magnet armature, this linear actuator is particularly suitable for use as a print wire actuator in the print head of a wire printer.

Figure 2:
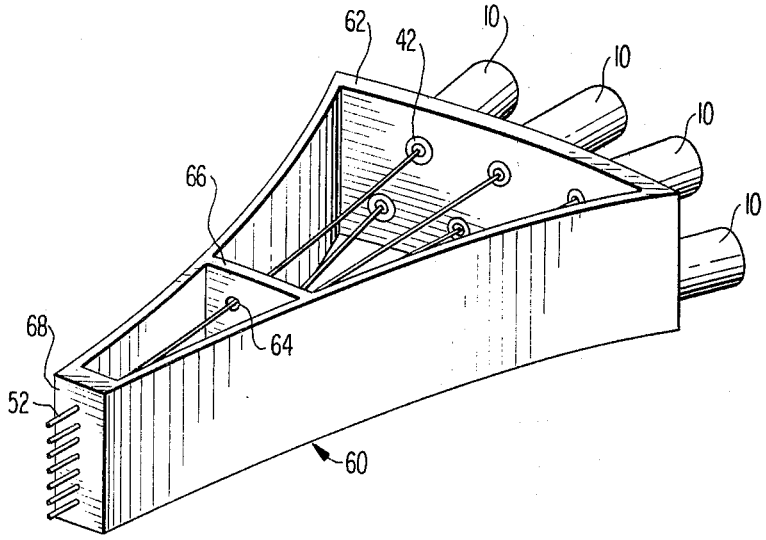
FIG. 2 is a perspective view illustrating the manner in which a plurality of the actuators of the invention may be assembled in a matrix print head.

FIG. 2 illustrates the manner in which seven of the actuators 10 may be assembled into a seven-wire matrix print head 60. Each actuator 10 is secured to the print head by threading the bushing 42 into a corresponding threaded opening in the rear wall 62 of print head 60. There are three such threaded openings in the top row of the wall 62, and four such threaded openings in the bottom row of the wall. The seven print wires extend through seven corresponding, but closer spaced, openings, such as 64 in an intermediate wall 66 and then extend through seven vertically aligned openings in the front wall 68 to form a vertical seven-wire printing matrix.

I claim:

1. A spring-less reciprocating electromagnetic linear actuator comprising:

a housing;

a substantially cylindrical electromagnetic coil mounted in said housing and having a central passageway extending along the coil axis;

a ferromagnetic pole piece disposed in the passageway to form an air gap at one end of said passageway;

a permanent magnet armature disposed in the air gap for movement along the coil axis, one end of said armature normally being held against the adjacent end of said pole piece by magnetic attraction when said coil is de-energized;

means for energizing said coil, for only a predetermined time period, with electric current to form in said adjacent end of said pole piece a magnetic pole of the same polarity as that of said one end of said permanent magnet armature to repel said armature away from said adjacent end in a first direction; and means for blocking the travel of said armature in said first direction after a predetermined travel distance and for causing said armature to rebound in the opposite direction towards said adjacent end of said pole piece;

said predetermined time period being less than the time required for said armature to move said predetermined travel distance, so that the rebounding armature is magnetically attracted to, and held against, said adjacent end of said pole piece, said coil being de-energized during rebounding of said armature.

2. An actuator as defined in claim 1 further comprising utilization means operated by said armature for producing work.

3. An actuator as defined in claim 1 wherein:

said blocking means is a printing medium; and said utilization means comprises a printing wire fixed to the other end of said armature, so that the free end of said wire strikes said printing medium at the end of said predetermined travel distance.

4. An actuator as defined in claim 1 wherein said energizing means comprises means for applying a direct current pulse to said coil, the duration of said pulse being substantially equal to said predetermined time period.

* * * * *